United States Patent [19]

Gill

[11] Patent Number: 5,022,491

[45] Date of Patent: Jun. 11, 1991

[54] COLLAPSIBLE FIRE ESCAPE LADDER

[76] Inventor: Joseph Gill, 95 Shelley Ave., Staten Island, N.Y. 10314

[21] Appl. No.: 564,845

[22] Filed: Aug. 9, 1990

[51] Int. Cl.[5] ..... E06C 9/10; E06C 9/14

[52] U.S. Cl. ..... 182/95; 182/70; 182/163

[58] Field of Search ..... 182/95, 86, 163, 164, 182/70, 197

[56] References Cited

U.S. PATENT DOCUMENTS

| | | | |
|---|---|---|---|
| 261,847 | 8/1882 | Graff | 182/95 |
| 280,527 | 7/1883 | Smiley | 182/70 |
| 389,696 | 9/1888 | Fink | 182/95 |
| 494,073 | 3/1893 | Necker | 182/163 |
| 1,064,166 | 6/1913 | Murphy | 182/95 |
| 1,203,313 | 10/1916 | Danke | 182/95 |
| 2,513,835 | 7/1950 | Allen | 182/70 |
| 2,615,665 | 10/1952 | Baxter | 182/164 |
| 3,042,143 | 7/1962 | Silen | 182/163 |
| 4,401,183 | 8/1983 | Schler | 182/95 |

*Primary Examiner*—Reinaldo P. Machado
*Attorney, Agent, or Firm*—Auslander & Thomas

[57] ABSTRACT

A collapsible fire escape ladder. A plurality of folding ladder sections are retained in the folded position by a retractable ladder retention means that slidably engages retention posts fixedly attached to the respective ladder sections. A pivotally mounted ladder entry step is attached to the proximal end of the ladder retention means to facilitate emergency escape through a window or the like. In an alternative embodiment of the ladder, the ladder retention means includes an exit platform having an exit portal disposed when said ladder retention means is retracted above the rungs of the ladder sections.

14 Claims, 4 Drawing Sheets

FIG. 1
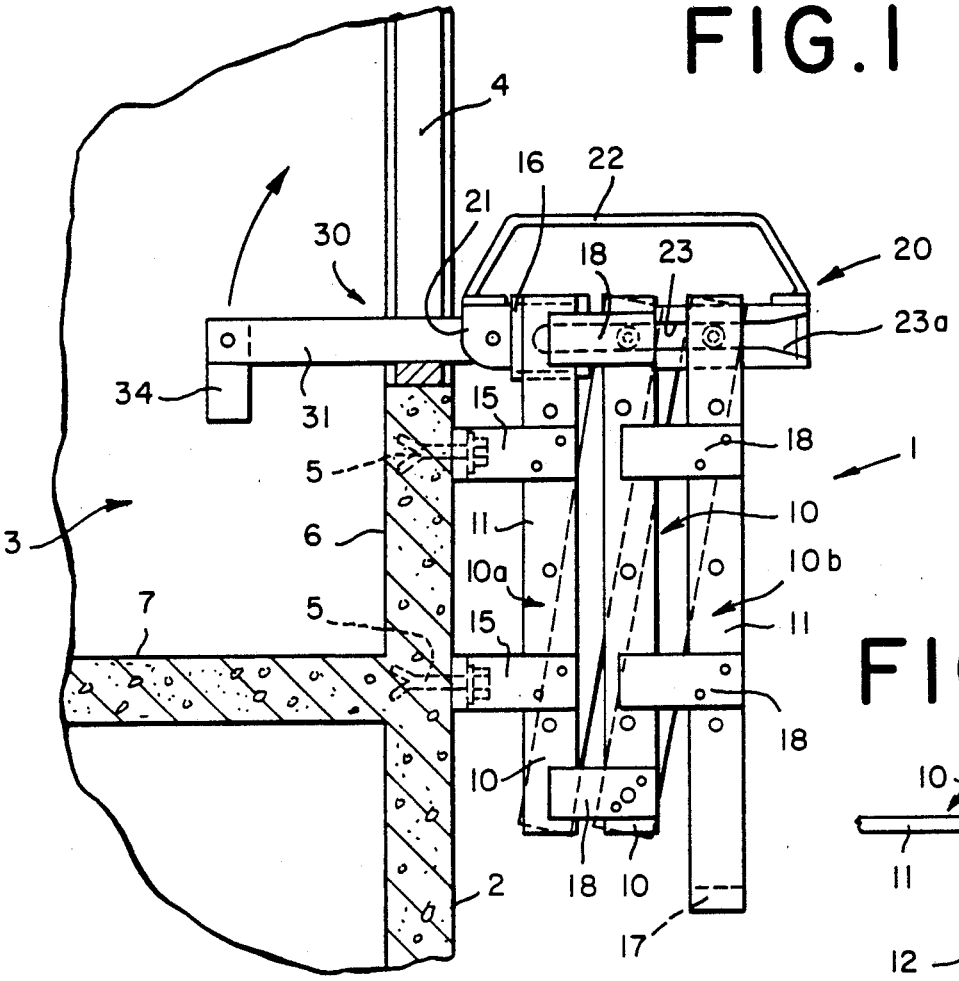
FIG. 3
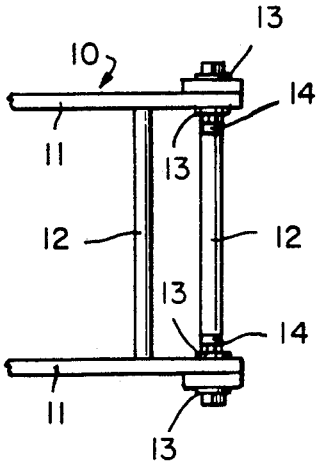
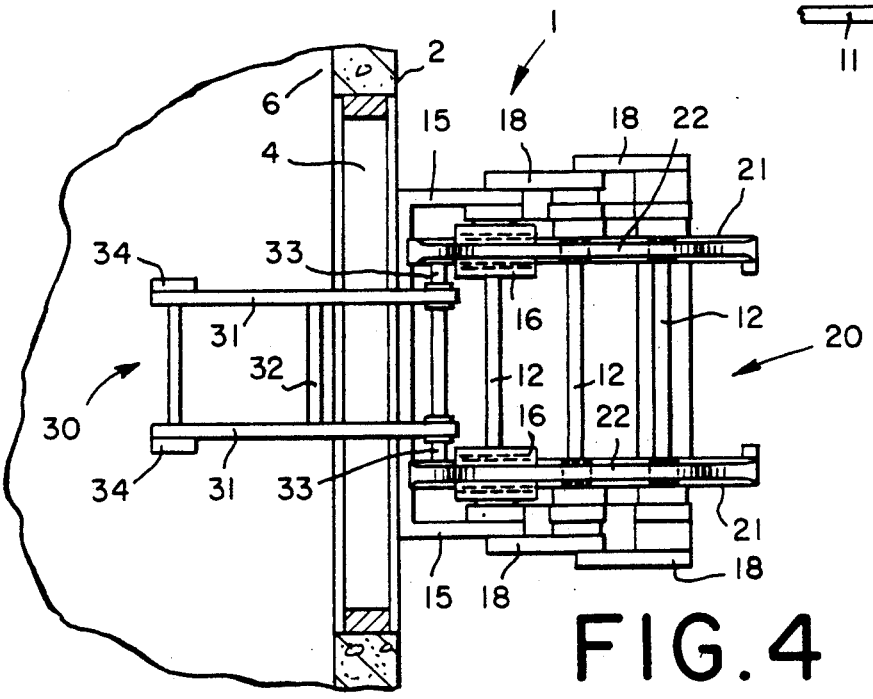
FIG. 4

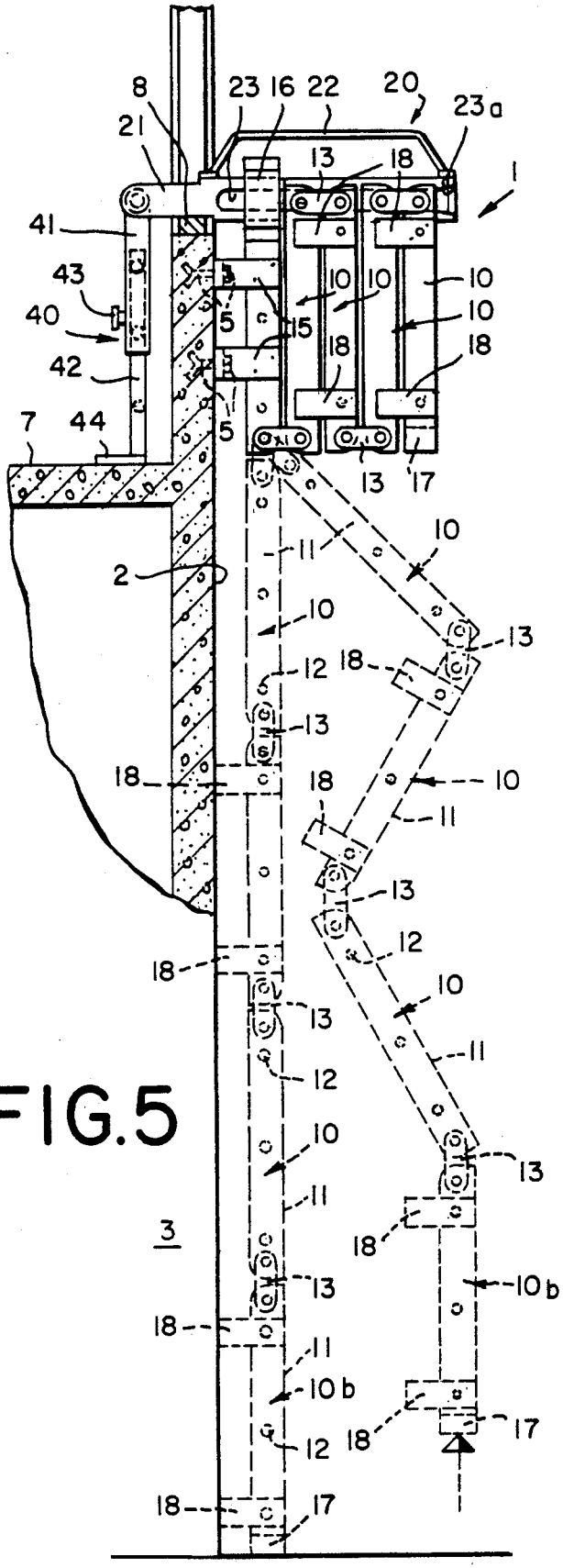
FIG.5
FIG.2
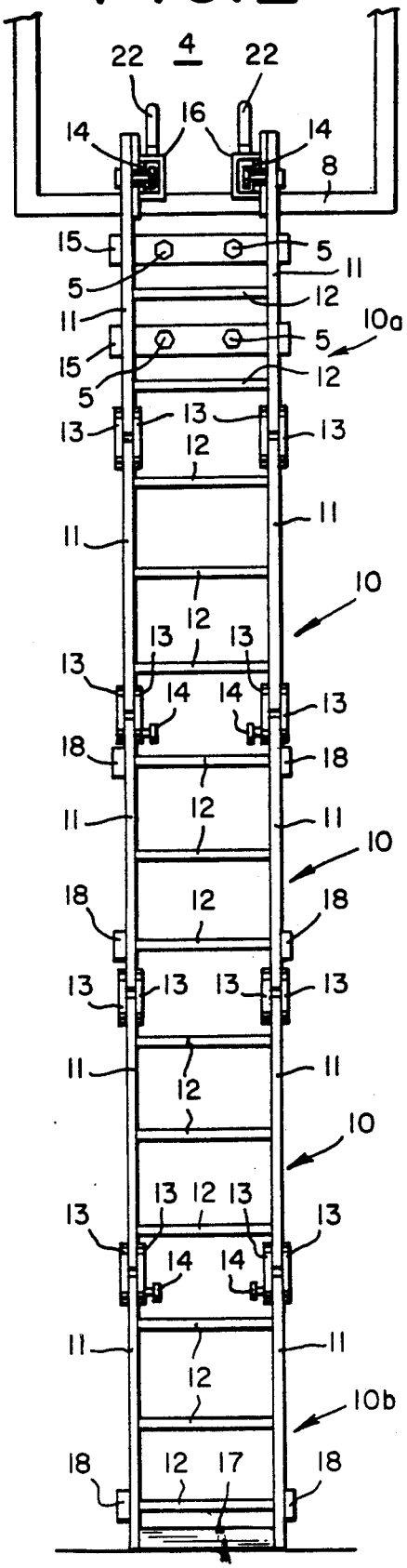

FIG. 7
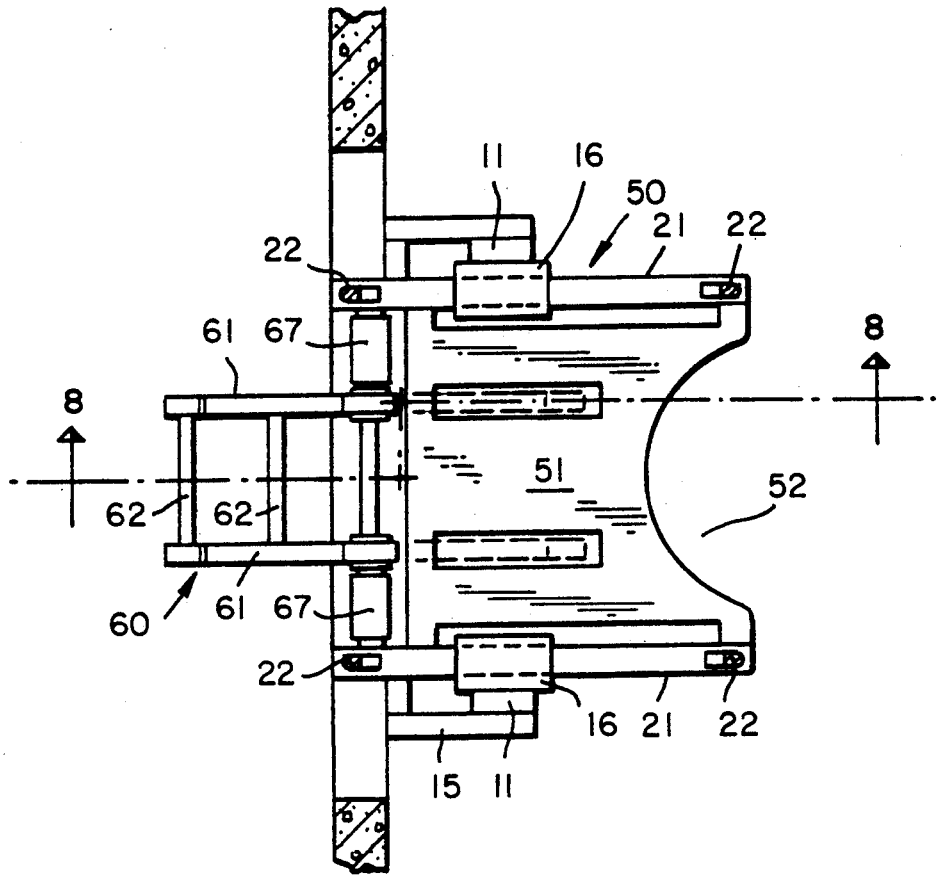
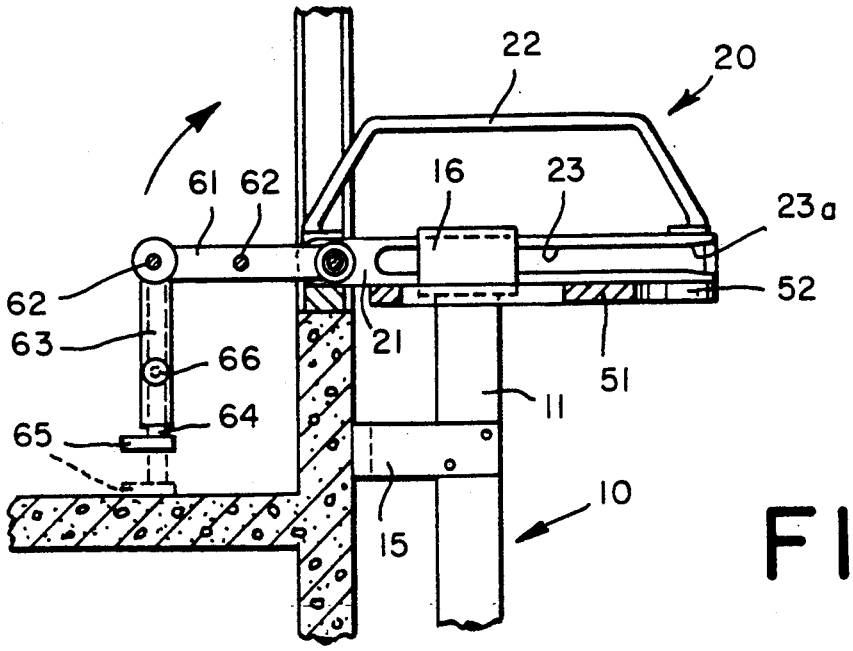
FIG. 8

COLLAPSIBLE FIRE ESCAPE LADDER

BACKGROUND OF THE INVENTION

The present invention relates to collapsible fire escape ladders for emergency exit through a window or from a roof. More particularly, the present invention relates to a collapsible fire escape ladder having improved ladder descent means that enhance safety during use.

Collapsible fire escape ladders generally comprise folded sections and are provided in multi-story buildings below or adjacent to a window or roof ledge so that the ladder can be readily unfolded to extend to or near the surrounding ground. Various means have been utilized in the prior art to retain the ladder in its collapsed position proximate to the window or ledge. Such retention means must be easily and quickly disengageable for release of the ladder sections in an emergency situation.

Collapsible fire escape ladders must also be safe to descend during an emergency. A person fleeing a fire or other hazard is usually nervous and excited and can easily misstep if sufficiently safe descent means are not provided in the ladder. Ladders are generally climbed or descended with the person turned facing the ladder. Because of this backward disposition when descending, a person cannot easily see the rungs below. Descending a ladder while turned backwards is particularly problematic when initially accessing the ladder from a window or roof, as the person must move blindly through the window or across the ledge. One misstep can lead to a fatal or serious injury. Thus, there is a need for a collapsible fire escape ladder having safe means to access the ladder from a window or roof and descend therefrom.

DESCRIPTION OF THE RELATED ART

Various collapsible fire escape ladders have been disclosed in the prior art and can be generally categorized as (1) portable escape ladders and (2) permanently affixed escape ladders.

The portable collapsible fire escape ladders of the prior art have been primarily directed to providing improved means of attaching the ladder to a window or roof or to improved means of folding the ladder subsequent to use.

U.S. Pat. No. 2,615,665 to Baxter discloses a portable collapsible fire escape ladder having clamping means to quickly secure the ladder to a window or like opening in a building.

U.S. Pat. No. 3,042,143 to Silen discloses a portable collapsible fire escape ladder having U-shaped window-sill-engaging rods for securement of the ladder. The Silen patent also discloses wall spacing members disposed at displaced positions along the length of the ladder to maintain the ladder away from the vertical wall of the building.

U.S. Pat. No. 494,073 to Necker discloses a portable collapsible fire escape ladder which automatically unfolds when dropped from a window and includes a rope and crank mechanism to refold the ladder after use.

The permanently affixed collapsible fire escape ladders of the prior art include rope and pulley fold and release mechanisms and other ladder storage means.

In U.S. Pat. No. 261,847 to Graff, a collapsible fire escape ladder is disclosed that is stored in a box attached adjacent to a window. The ladder disclosed in the Graff patent further includes a platform at its lower end to facilitate exit from the ladder to the surrounding ground.

U.S. Pat. No. 280,527 to Smiley discloses a collapsible fire escape ladder having an alarm attachment comprising a bell that rings when the ladder is released. The Smiley escape ladder also includes a rope and pulley release mechanism.

U.S. Pat. No. 389,696 to Fink discloses a collapsible fire escape ladder having sliding sleeves which engage joints of the ladder sections to secure the ladder in its extended position. The ladder is retained in its folded position by means of an endless-chain pulley mechanism.

While the collapsible fire escape ladders of the prior art provide means for emergency escape from a building, certain limitations are inherent in the disclosed constructions. These limitations are overcome by the collapsible fire escape ladder of the present invention.

SUMMARY OF THE INVENTION

The present invention is a collapsible fire escape ladder that fixedly attaches to the outside of a building adjacent to a window or roof ledge. The escape ladder includes a plurality of foldable ladder sections, the lowermost ladder section being weighted so that the ladder will unfold under the force of gravity when the ladder retention means are released. The ladder retention means includes frame members that slidably engage retention posts disposed on the inside portions of the ladder sections to secure the folded ladder in place. By retracting the ladder retention means from the retention posts, the ladder sections fall adjacent to the vertical wall of the building.

The ladder retention means further includes an exit platform having an exit opening formed at the distal end of the exit platform to facilitate safe access to the unfolded ladder sections. A ladder entry step is pivotally attached to the proximal end of the ladder retention means to facilitate entry to the escape ladder from a room or the roof of the building.

The present invention and the manner in which it may be carried, may be further understood by reference to the following description of preferred embodiments and the accompanying drawings.

BRIEF DESCRIPTION OF THE DRAWINGS

FIG. 1 is a side plan view of the collapsible escape ladder of the present invention shown in its folded and retained position.

FIG. 2 is a front plan view of the present invention shown in its unfolded position.

FIG. 3 is an isolated fragmentary top plan view of a ladder section.

FIG. 4 is a top plan view of the collapsible escape ladder of the present invention shown in its folded and retained position.

FIG. 5 is a side plan of the present invention showing in phantom the unfolding of the ladder sections and a second embodiment of the ladder entry step.

FIG. 7 is a top plan view of the invention shown having an exit platform attached to the ladder retention means.

FIG. 8 is a cross-sectional view taken along line 8—8 of FIG. 7.

DETAILED DESCRIPTION OF A PREFERRED EMBODIMENT

Figure 6:
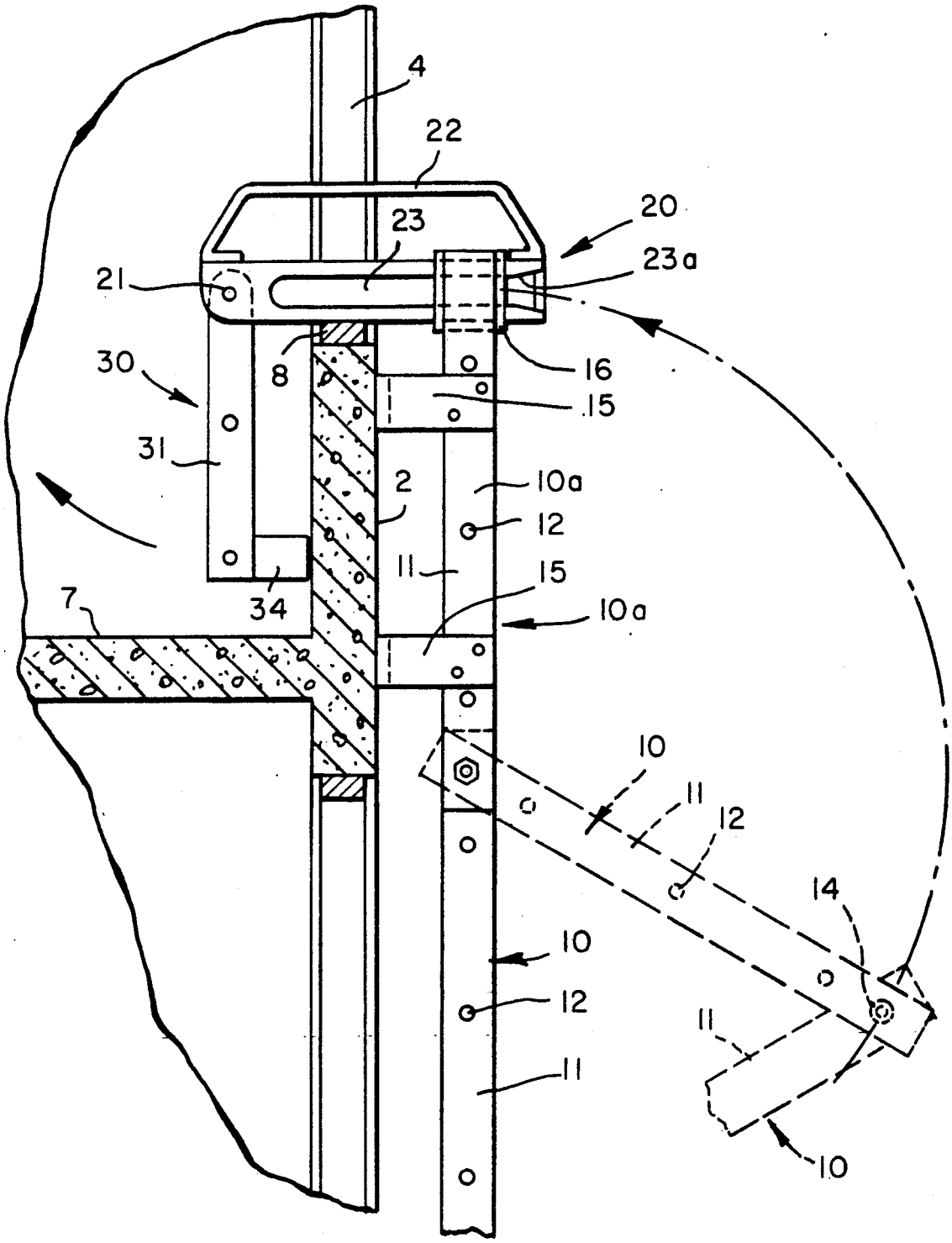
FIG. 6 is a side plan cross-sectional view of the collapsible escape ladder of the present invention.

Reference is now made to the figures which illustrate in greater detail the present invention, where like reference numbers denote like parts in the various figures.

The collapsible fire escape ladder 1 of the present invention is shown in its folded and retained position in FIG. 1. The escape ladder 1 is fixedly attached to a vertical wall 2 of a building 3 adjacent to a window 4 or like opening in the building 3 by suitable wall attachment means 5 to secure the escape ladder 1 in rigid engagement with said vertical wall 2. The collapsible escape ladder 1 generally includes a plurality of ladder sections 10, 10*a*, 10*b*, ladder retention means 20 and a ladder entry step 30.

FIG. 2 illustrates in a front plan view the escape ladder 1 of the present invention disposed in its unfolded position. It can be seen that the respective ladder sections 10 comprise paired ladder uprights 11 having a plurality of ladder rungs 12 horizontally disposed thereinbetween. The respective ladder sections 10 are pivotally attached at respective ends thereof to adjacently disposed ladder sections 10 by means of rotatably engaging mounting plates 13 disposed to each side of the ladder uprights 11. Ladder section retention posts 14 are inwardly disposed at alternate mounting plates 13 so that the retention posts 14 will align horizontally when the ladder sections 10 are disposed in the folded position for engagement of the ladder retention means 20 as described hereinafter in greater detail. Ladder section retention posts 14 are preferably fixedly attached rollers as illustrated in greater detail in the fragmented top view of a ladder section 10 shown in FIG. 3.

Referring to FIGS. 1 and 2, it can be seen that the uppermost ladder section 10*a* includes a pair of c-shaped wall mount frame members 15 which are fixedly attached to the ladder uprights 11 of said uppermost ladder section 10*a* and receive the wall attachment means 5 to rigidly attach the uppermost ladder section 10*a* to the vertical wall 2 of the building 3. The uppermost ladder section 10*a* also includes at the upper end of ladder uprights 11 retention means guide blocks 16 which receive in sliding engagement retention means frame members 21 of the ladder retention means 20.

The lowermost ladder section 10*b* includes a counterweight 17 disposed between the ladder uprights 11, said counterweight 17 being of sufficient weight to cause the ladder sections 10, 10*b* to unfold under the force of gravity when the ladder retention means 20 is retracted.

The third and subsequently alternate ladder sections 10 (counting from the top of the escape ladder 1) include paired wall-spacing members 18 fixedly attached to respective ladder uprights 11. The wall spacing members 18 extend from the ladder uprights 11 toward the vertical wall 2 of the building 3 (FIG. 1) to support the ladder sections 10 displaced from the vertical wall 2. downwardly successive pairs of wall-spacing members 18 may be formed having increasing lengths to cause the escape ladder 1 to extend progressively outward when unfolded and positioned for use.

Reference is now made to FIG. 1 and the top plan view of the fire escape ladder 1 shown in FIG. 4. The ladder retention means 20 can be seen to comprise a pair of elongated retention means frame members 21 having handrails 22 fixedly attached to the top portion of the retention means frame members 21. Each retention means frame member 21 includes an elongated channel 23, having beveled channel ends 23*a*, which extend from the distal end of the retention means frame member 21 to approximately the proximal end thereof. The elongated channels 23 of the retention means frame members 21 engage the retention posts 14 of the respective ladder sections 10 when said ladder sections 10 are disposed in the folded position. In the several drawing figures disclosed wherein the elongated channel 23 is shown to lay horizontally, however, the channel 23 may be formed downwardly inclined from the distal end of the retention frame member 21 to its proximal end. Such construction of the elongated channel 23 facilitates retention of ladder sections 10 in their folded position.

The ladder entry step 30 shown in FIGS. 1 and 4 comprises paired entry step uprights 31 having a plurality of entry step rungs 32 horizontally disposed therebetween. Ladder entry step 30 is rotatably attached to the proximal end of said ladder retention means 20 by rotatable engagement of the upper end of the entry step uprights 31 with entry step posts 33 attached to the proximal end of the retention means frame members 21 of said ladder retention means 20. Ladder entry step 30 further includes entry step wall-spacing members 34 attached to the respective entry step uprights 31 at their lower end thereof. The step wall-spacing members 34 are disposed toward the inside wall 6 of the vertical wall 2 of the building 3 below the window 4.

A second embodiment of entry step 40 is illustrated in FIG. 5. Said second entry step 40 includes paired step uprights 41 and a plurality of entry step rungs (not shown) as heretofore described, the step uprights being rotatably attached to the proximal end of the retention frame members 21. A step leg 42 is telescoped within the respective step uprights 41, said step leg 42 being selectively adjustable at various extensions by threaded leg fastener means 43. A step foot 44 is attached perpendicularly to said step leg 42, being disposed to bear on the floor 7 of a room within the building 3 to support the entry step 40 during use.

The fire escape ladder 1 of the present invention is positioned adjacent to a window 4 in a manner such that when the ladder retention means 20 are from the retention posts 14, allowing the ladder sections 10 to fall downwardly, the retention means frame members 21 bear on the windowsill 8 of window 4 (FIG. 6). Thereafter, the entry step 30 (or 40) is rotated away from the ladder retention means 20 to provide simple and safe means for accessing the escape ladder 1.

FIGS. 7 and 8 illustrate a second embodiment of the ladder retention means 50 and a third embodiment of the ladder entry step 60. The second ladder retention means 50 illustrated in FIGS. 7 and 8 includes a pair of elongated retention means frame members 21 having a handrail 22 fixedly attached to the top surface of the respective retention means frame members 21 as heretofore shown and described. The retention means frame members 21 slidably engage the retention means guide blocks 16. An elongated channel 23 having beveled ends 23*a* is formed in the retention frame members 51 as previously shown and described for receipt of the retention posts 14 of the ladder sections 10. Said second ladder retention means 50 further includes a ladder exit platform 51 fixedly attached to the bottom surfaces of the retention means frame members 21. Exit platform 51 is substantially a flat plate member having an exit portal 51 formed at the distal end of said exit platform 51. The exit portal 52 facilitates access to the uppermost ladder sections 10a by providing a clear opening to the ladder rungs 12 of the uppermost ladder section 10a. The exit portal 52 shown in FIGS. 7 and 8 is formed as a semicircular cutaway portion of the exit platform 51, however, the exit portal 52 may be formed having various shapes and by various means, for example, exit portal 52 may be formed as a circular opening disposed in exit platform 51.

The third embodiment of the ladder entry step 60 is formed having a pair of first steps uprights 61 having first step upright rungs 62 disposed therebetween, a pair of second step up rights 63 pivotally attached at the upper end to the respective lower ends of said first step uprights 61, second step upright rungs (not shown) being disposed between said second step uprights 63, and a third step legs 64, including a third step foot 65 telescopically attached to said second step uprights 63 and adjustably fastenable thereto by third leg fastener means 66. The upper ends of the respective first step uprights 61 are rotatably attached to the proximal end of the retention means frame members 21 by rotatable engagement with third entry step posts 67.

Operation of the fire escape ladder 1 of the present invention should be readily understood from the foregoing description. The escape ladder 1 is stored in its folded position (FIG. 1) with the elongated slots 23 formed in the retention means frame members 21 of the ladder retention means 20 slidably engaging the retention posts 14 of the respective ladder sections 10. The ladder retention means 20 is positioned adjacent to a building window 4 or like opening such that the bottom surface of the ladder retention means 20 can clear the windowsill 8 when retracted from its engaging position. The ladder sections 10 are released by retracting the ladder retention means 20 from the retention posts 14, thereby allowing the ladder sections 10 to unfold under the force of gravity. The ladder retention means 20 are thus disposed inside the room from which escape is desired. The ladder entry step 30 or 40 or 60 is then rotated downwardly and, if applicable, the step legs 42 or 64 are adjusted to secure the ladder entry step 40 or 60. Access to the ladder sections 10 can now be readily made by climbing the entry step 30 or 40 or 60, turning backwards while holding the handrails 22 and descending the rungs 12 of the ladder sections through the exit portal 52, if applicable. The terms and expressions which are employed are used as terms of description; it is recognized, though, that various modifications are possible. Such modifications of the preferred embodiments of the present invention are within the spirit and scope of the appended claims.

It is also understood that the following claims are intended to cover all of the generic and specific features of the invention herein described and all statements of the scope of the invention which, as a matter of language, might fall therebetween.

Having described certain forms of the invention in some detail, what is claimed is:

1. A collapsible escape ladder fixedly attachable to a vertical wall of a building and the like comprising a plurality of ladder sections comprising paired uprights and a plurality of ladder rungs, said ladder sections being pivotally attached at respective ends thereof, a first end ladder section being fixedly attached to the vertical wall, a second end ladder section having a counterweight attached thereto, said ladder sections having inwardly disposed retention posts attached at the pivot points between adjacent ladder sections, said first end ladder section having inwardly disposed retention posts attached at the upper ends of the respective uprights; and ladder retention means slidably attached to the uprights of said first end ladder section which slidably engage the retention posts of said ladder sections when said ladder sections are sequentially folded adjacent to said first end ladder section to secure the folded ladder in place and selectively release said ladder sections when slidably retracted from said retention posts.

2. The invention of claim 1 further including a plurality of paired wall-spacing members fixedly attached to respective uprights of the several ladder sections.

3. The invention of claim 2 wherein sequentially disposed said paired wall-spacing members are formed having increasing lengths.

4. The invention of claim 1 wherein said ladder retention means includes handrails upwardly disposed from said ladder retention means.

5. The invention of claim 1 wherein said ladder retention means includes an exit platform fixedly attached to said ladder retention means.

6. The invention of claim 5 wherein said exit platform includes an exit portal formed at the distal edge of said platform.

7. The invention of claim 1 wherein said retention means comprises a pair of longitudinal retention means frame members having a channel formed therein which extends from the distal end of said frame members to near the proximate end of said frame member, the retention posts disposed on said ladder sections being slidably receivable within the channels of said frame members.

8. The invention of claim 7 wherein said frame members have a rectangular cross-section.

9. The invention of claim 7 wherein said channel is angled downwardly from the distal end to the proximal end of said retention means frame member.

10. The invention of claim 1 wherein said retention posts comprise fixedly attached rollers.

11. The invention of claim 1 further including a ladder entry step pivotally attached to the proximal end of the ladder retention means.

12. The invention of claim 11 wherein the ladder step includes a leg telescopically attached to the free end of said ladder step.

13. The invention of claim 11 said ladder step includes wall-spacing members fixedly attached to the free end of said ladder step.

14. A collapsible escape ladder fixedly attachable to a vertical wall of a building comprising a plurality of foldable ladder sections;

ladder retention means which slidably engage said plurality of ladder sections when folded to retain said ladder sections in their folded position; and a ladder entry step rotatably attached to said ladder retention means in an manner to permit said ladder entry step to be accessed from said building;

each of said ladder sections comprising paired ladder uprights having ladder rungs disposed horizontally therebetween, said ladder sections being pivotally attached at respective ends thereof by mounting plates disposed on each side of said ladder uprights, alternate ladder sections including paired wall-spacing members fixedly attached to the respective ladder uprights, sequential pairs of said wall-spacing members being formed at increasing lengths, said wall-spacing members being disposed from said ladder uprights toward said building, a first end ladder section including a pair of c-shaped wall mount frame members disposed in vertical alignment and attached to the ladder uprights of said first end ladder section, said first end ladder section being fixedly attachable to said building by wall attachment means which engage said wall mount frame members, said first end ladder section further including retention means guide blocks fixedly attached to the upper portion of the ladder uprights of said first end ladder section, said ladder retention means being slidably receivable within said retention means guide blocks, a second end ladder section having a counterweight fixedly attached thereto, said ladder sections having inwardly disposed ladder section retention posts attached to said mounting plates, said first end ladder section having inwardly disposed ladder section retention posts attached at the upper ends of the respective ladder uprights within said retention means guide blocks, said retention posts comprising fixedly attached rollers, said ladder retention means comprising paired retention means frame members receivable within said retention means guide blocks, handrails being fixedly disposed on the top surface of said retention means frame members, an exit platform being fixed attached to the bottom surface of said retention means frame members, said retention means frame members having an elongated channel formed therein which receives in sliding engagement the ladder section retention posts of said ladder sections, said elongated channel having beveled ends at the distal end thereof, said channel extending from the distal end of said retention means frame members to near the proximal end thereof, said exit platform having an exit portal formed at the distal end thereof.

* * * * *